US007163414B2

(12) United States Patent
Lo et al.

(10) Patent No.: US 7,163,414 B2
(45) **Date of Patent: *Jan. 16, 2007**

(54) AXIAL LATCH ACTUATOR WITH LOCKING WEDGE

(75) Inventors: Denny Lo, Danbury, CT (US); Maxwell Yip, Trumbull, CT (US)

(73) Assignee: The Siemon Company, Watertown, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/353,568

(22) Filed: Feb. 14, 2006

(65) Prior Publication Data

US 2006/0134963 A1 Jun. 22, 2006

Related U.S. Application Data

(63) Continuation of application No. 10/979,313, filed on Nov. 2, 2004, now Pat. No. 7,037,129, which is a continuation-in-part of application No. 10/408,976, filed on Apr. 8, 2003, now Pat. No. 6,863,556.

(60) Provisional application No. 60/375,786, filed on Apr. 26, 2002.

(51) Int. Cl.
*H01R 13/627* (2006.01)

(52) U.S. Cl. ..... 439/352; 439/354

(58) Field of Classification Search ..... 439/350–357
See application file for complete search history.

(56) References Cited

U.S. PATENT DOCUMENTS

| | | | | |
|---|---|---|---|---|
| 4,273,403 | A | 6/1981 | Cairns | |
| 5,011,424 | A | 4/1991 | Simmons | |
| 5,334,044 | A | 8/1994 | Falossi et al. | |
| 5,385,484 | A | 1/1995 | Bartle et al. | |
| 5,451,165 | A | 9/1995 | Cearley-Cabbiness et al. | |
| 5,507,666 | A | 4/1996 | Yamanashi | |
| 5,538,438 | A | 7/1996 | Orlando | |
| 6,083,052 | A | 7/2000 | Adams et al. | |
| 6,116,939 | A | 9/2000 | Fukuda | |
| 6,250,942 | B1 | 6/2001 | Lemke et al. | |
| 6,302,721 | B1 | 10/2001 | Turner et al. | |
| 6,328,601 | B1 | 12/2001 | Yip et al. | |
| 6,358,091 | B1 | 3/2002 | Lo et al. | |
| 6,368,143 | B1 | 4/2002 | Adams | |
| 6,371,794 | B1 | 4/2002 | Bauer et al. | |
| 6,863,556 | B1 | 3/2005 | Viklund et al. | |
| 7,037,129 | B1 * | 5/2006 | Lo et al. | 439/352 |
| 2003/0220008 | A1 | 11/2003 | Viklund et al. | |

FOREIGN PATENT DOCUMENTS

EP WO 03/091517 A 11/2003

OTHER PUBLICATIONS

European Search Report, EP 05 35 6059, Feb. 6, 2006.

* cited by examiner

*Primary Examiner*—Ross Gushi
*Assistant Examiner*—Larisa Tsukerman
(74) *Attorney, Agent, or Firm*—Cantor Colburn LLP

(57) ABSTRACT

An axial latch actuator includes: a mating portion having a latch for engaging a jack; and a slidable housing that slides along the mating portion and engages the mating portion, wherein when the slidable housing slides in a first direction, the mating portion is in a latched position and when the slidable housing slides in a second direction, the mating portion is in an unlatched position. The housing also includes a locking wedge. The latch in this embodiment includes first and second fingers adjacent to one another that extend over the mating portion and have first ends connected to the mating portion.

13 Claims, 19 Drawing Sheets

AXIAL LATCH ACTUATOR WITH LOCKING WEDGE

CROSS-REFERENCE TO RELATED APPLICATIONS

This application is a continuation of U.S. patent application Ser. No. 10/979,313 filed Nov. 2, 2004, now U.S. Pat. No. 7,037,129 the entire contents of which are incorporated by reference herein in their entirety, which is a continuation-in-part of U.S. application Ser. No. 10/408,976, filed Apr. 8, 2003, now U.S. Pat. No. 6,863,556 the entire contents of which are incorporated by reference herein in their entirety, which claims the benefit of U.S. Provisional Application Ser. No. 60/375,786, filed Apr. 26, 2002, the entire contents of which are incorporated by reference herein in their entirety.

BACKGROUND OF THE INVENTION

Many prevalent network systems, i.e., Ethernet, etc., require the use of a common modular plug. The modular plug includes opposing first and second ends. The first end is terminated with a cable. The second end is connected to a modular connector, thus forming a modular connection interface. The modular plug connects to a modular jack. The existing manner in which the modular plug is connected to the jack is through the use of a snap latching system, which is illustrated in FIG. 40. The user is required to push down on the latch to disengage the modular plug from the jack. When there are a number of modular plugs in close proximity (e.g., in a patch panel), each of the modular plugs are located next to each other and it is difficult for the user to reach the latch and disengage a specific modular plug.

SUMMARY OF THE INVENTION

The above discussed and other drawbacks and deficiencies of the prior art are overcome or alleviated by an axial latch actuator. In an exemplary embodiment, the axial latch actuator includes: a mating portion having a latch for engaging a jack; and a slidable housing that slides along the mating portion and engages the mating portion, wherein when the slidable housing slides in a first direction, the mating portion is in a latched position and when the slidable housing slides in a second direction, the mating portion is in an unlatched position. The housing also includes a locking wedge. The latch in this embodiment includes first and second fingers adjacent to one another that extend over the mating portion and have first ends connected to the mating portion.

In another exemplary embodiment, the axial latch actuator includes a mating portion having a latch for engaging a jack, the latch having a cam surface; and a slidable housing that is configured to receive the mating portion. The mating portion slides within the slidable housing and is configured to slidably engage the cam surface so as to disengage the latch with the jack.

BRIEF DESCRIPTION OF THE DRAWINGS

Referring now to the drawings wherein like elements are numbered alike in the several Figures.

DETAILED DESCRIPTION

Figure 1:
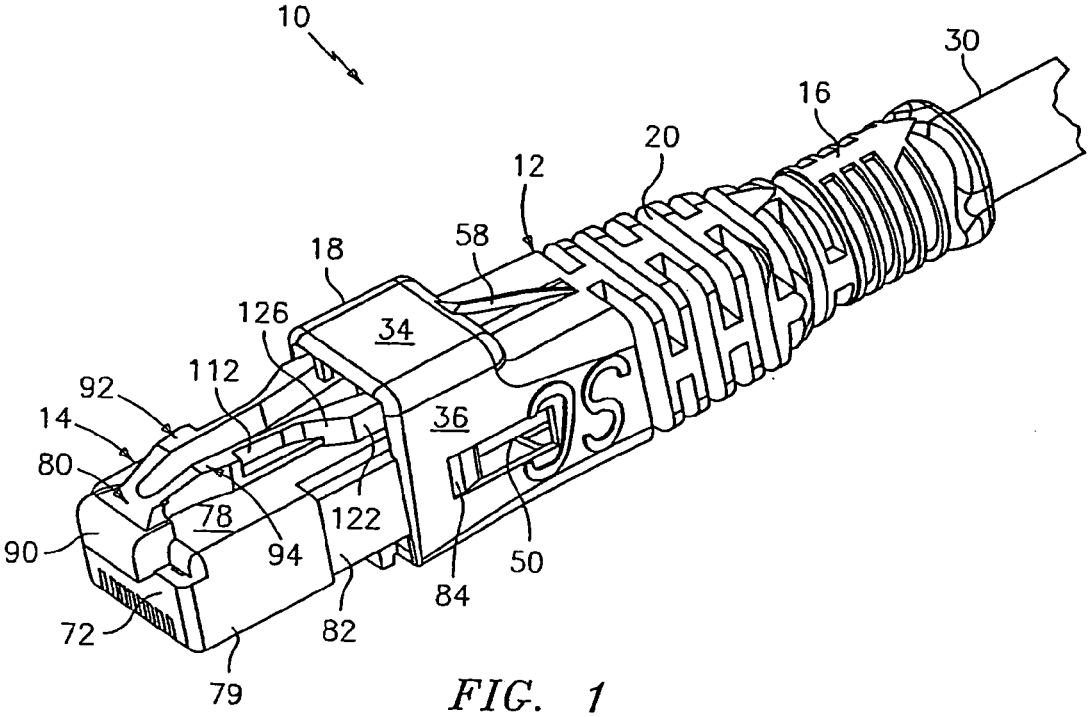
FIG. 1 is a front perspective view of a modular plug connected to a cable in an unlatched position.
Figure 2:
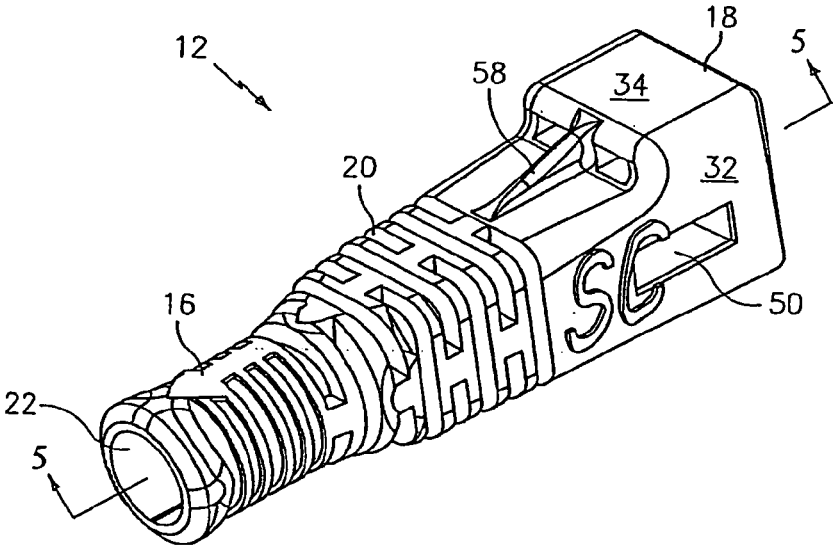
FIG. 2 is a back perspective views of a slidable housing of the modular plug of FIG. 1.
Figure 3:
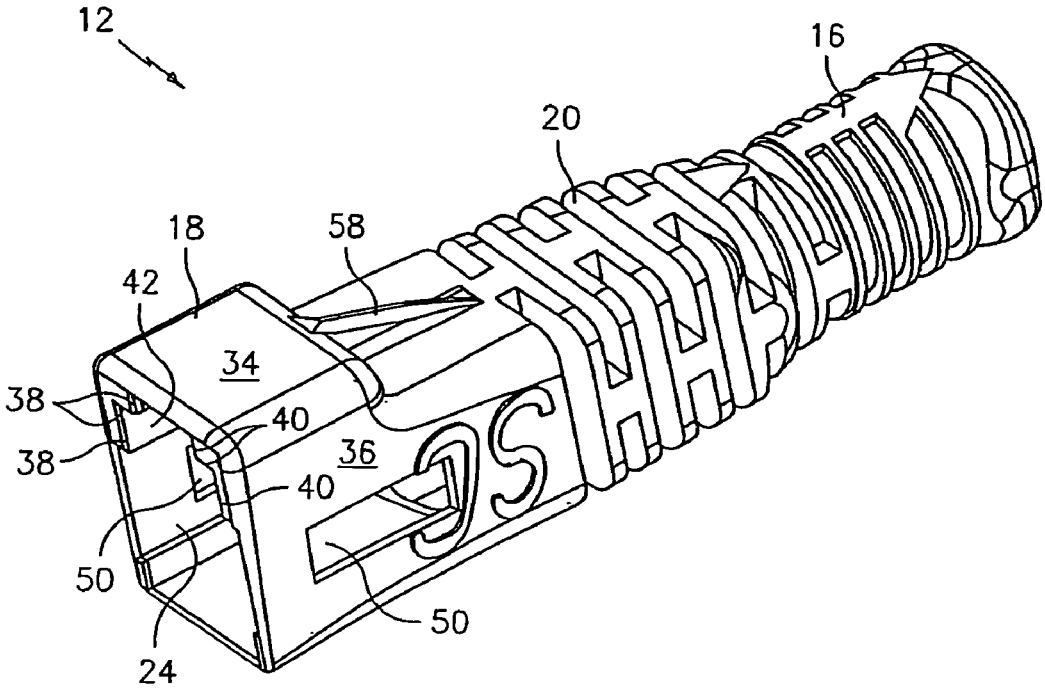
FIG. 3 is a front perspective view of a slidable housing of the modular plug of FIG. 1.
Figure 4:
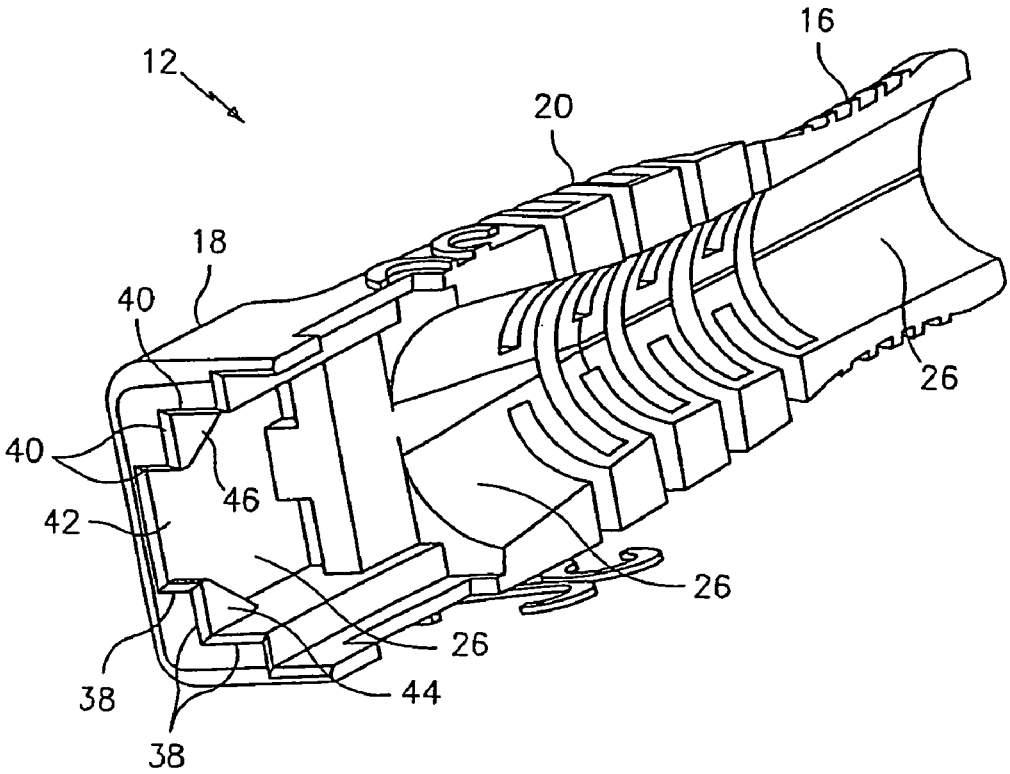
FIG. 4 is a perspective view of half the slidable housing of FIGS. 2–3.
Figure 5:
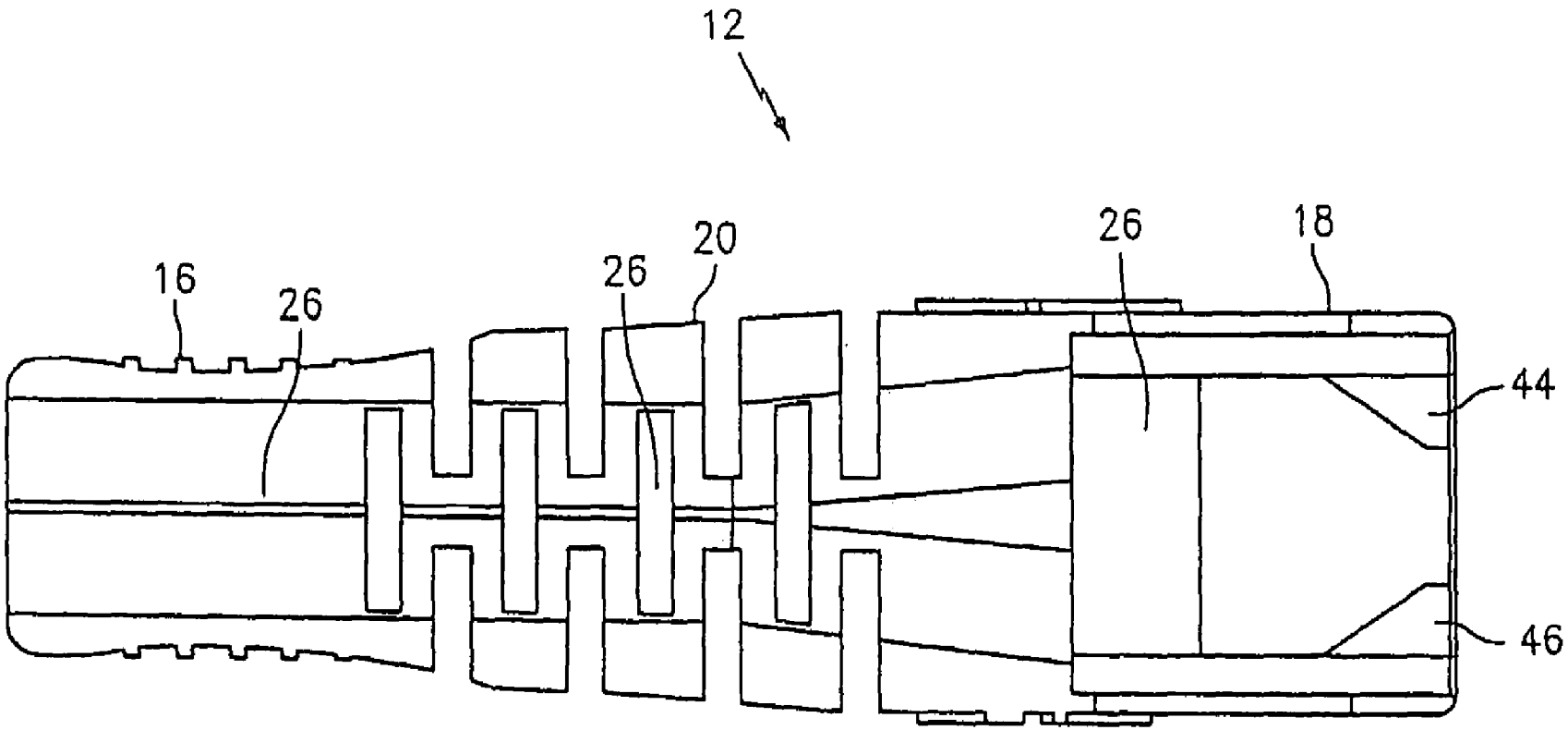
FIG. 5 is a bottom view of the inside of the slidable housing of FIG. 2.
Figure 6:
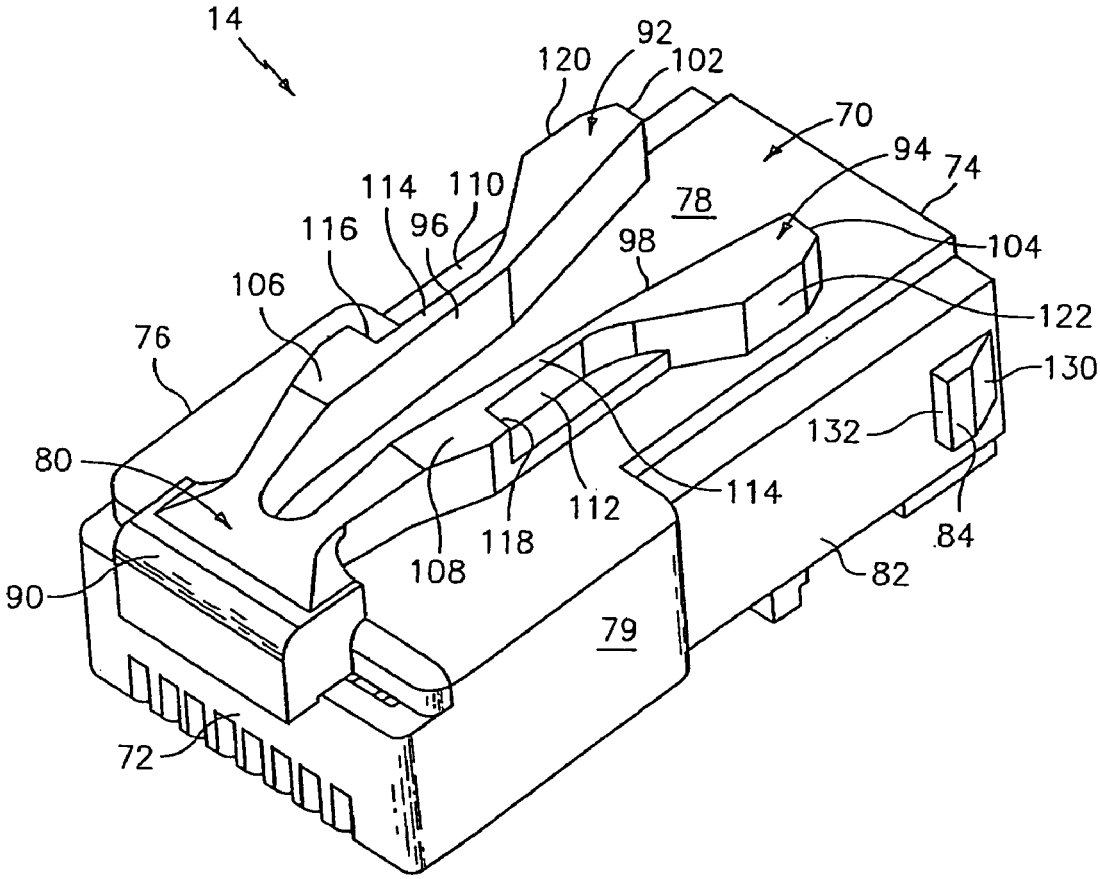
FIG. 6 is a front perspective view of a mating portion of the modular plug of FIG. 1.
Figure 7:
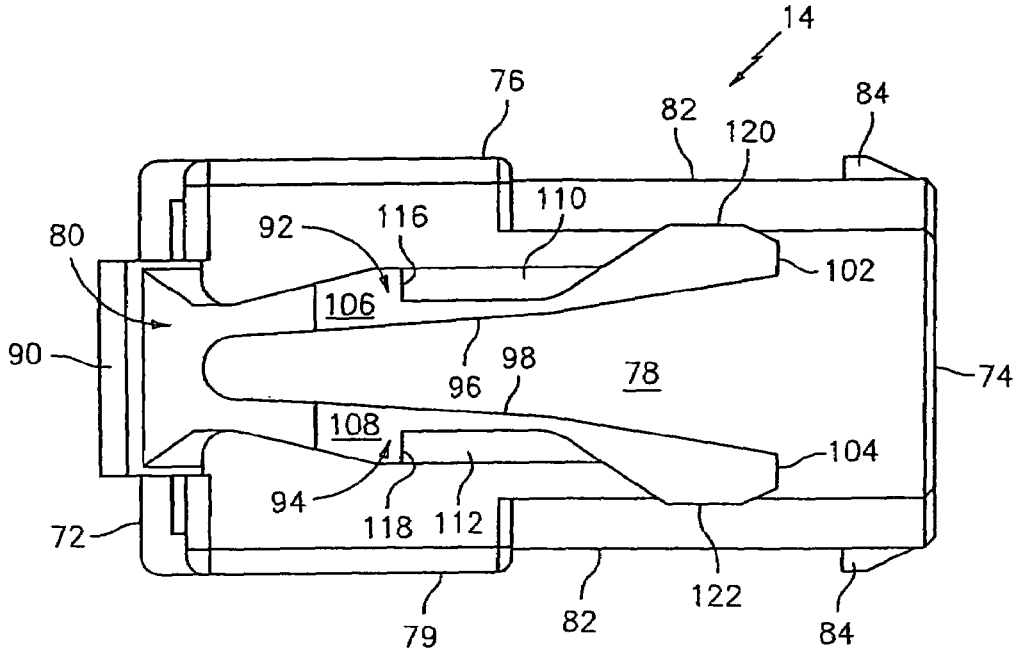
FIG. 7 is a top view of the mating portion of FIG. 6.
Figure 8:
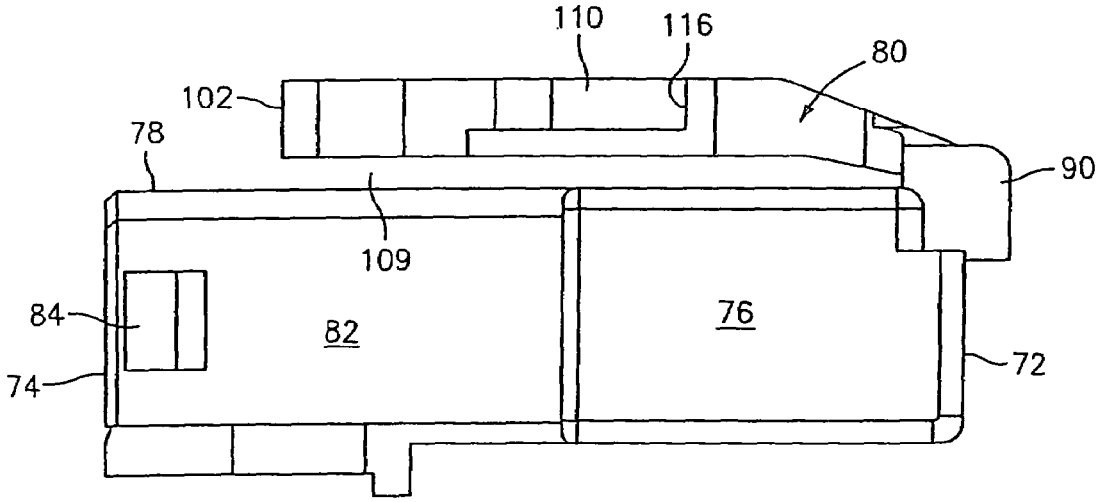
FIG. 8 is a side view of the mating portion of FIG. 6.
Figure 9:
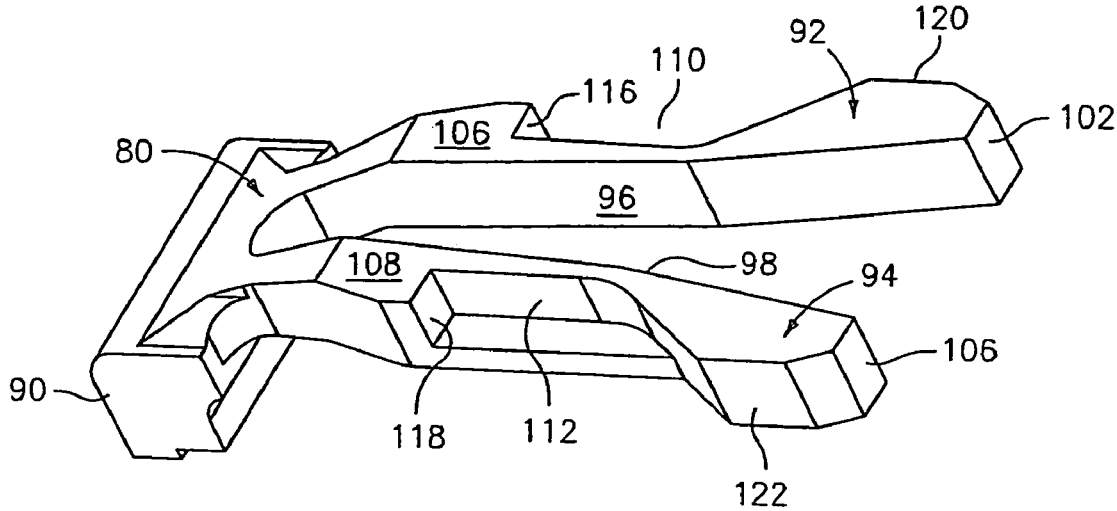
FIG. 9 is a side perspective view of a latch of the mating portion of FIG. 6.
Figure 10:
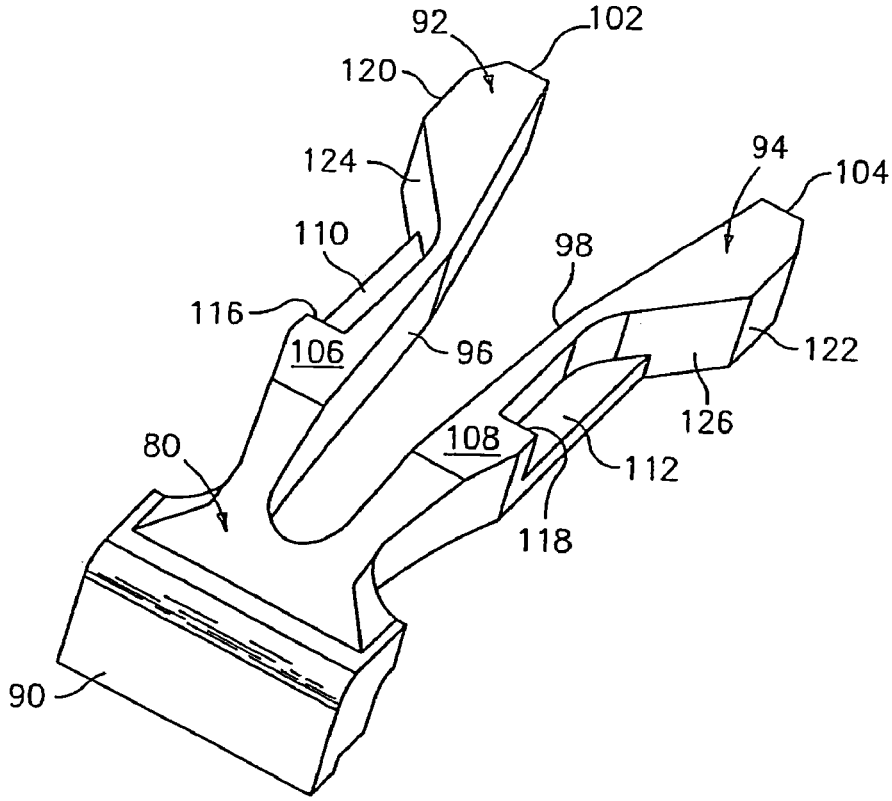
FIG. 10 is a side perspective view of a latch of the mating portion of FIG. 6.

Referring to FIG. 1, a modular plug 10 is illustrated. Plug 10 includes a slidable housing 12 and a mating portion 14. Mating portion 14 is partially received into housing 12.

Referring now to FIGS. 1–5, housing 12 has a first end 16, an opposing second end 18, and a middle portion 20. Both first end 16 and second end 18 have openings 22 and 24, with a chamber 26 disposed therebetween. Chamber 26 provides a pathway from first end 16 to second end 18. First end 16 is elongated to allow an operator to grasp housing 12. Opening 22 is sized to receive a cable 30.

Second end 18 is sized to receive mating portion 14. Second end 18 has a first side 32, a second side 34, and a third side 36. First side 32 is approximately parallel to third side 36, with second side 34 located approximately perpendicular to both first side 32 and third side 36.

Housing 12 includes contoured surfaces, which are located within chamber 26 and which engage mating portion 14. The contoured surfaces are as follows. A first stepped edge 38 is located at a corner of first side 32 and second side 34 and a second stepped edge 40 is located at a corner of second side 34 and third side 36. First stepped edge 38 mirrors second stepped edge 40 so as to form a cut out section 42 located at opening 24 and along second side 34. A first wedge 44 and a second wedge 46 are located within chamber 26 and directly behind first stepped edge 38 and second stepped edge 40, respectively. Both first side 32 and third side 36 have slots 50. Housing 12 generally tapers from second end 18 to first end 16, with second end 18 being larger than first end 16.

Second end 18 also has a sloped extension 58, which provides for a smooth transition from second end 18 to middle portion 20 and helps to prevent plug 10 from snagging as plug 10 is drawn through cabling areas.

Referring to FIGS. 1 and 6–10, mating portion 14 has a main body 70 with a first end 72 and an opposing second end 74. Main body 70 also has a first side 76, a second side 78, and a third side 79. First side 76 is approximately parallel to third side 79, with second side 78 located approximately perpendicular to both first side 76 and third side 79. Both first side 76 and third side 79 have indented portions 82. A plug stop 84 is located at second end 74 on both first side 76 and third side 79 at indented portions 82.

Mating portion 14 includes a latch 80 that is connected to first end 72 at a base 90. Latch 80 includes two fingers 92 and 94 that extend from base 90 over second side 78. Fingers have opposing sloped sides 96 and 98. Fingers 92 and 94 are located closest together at first end 72 and move apart from one another as fingers 92 and 94 extend away from base 90 over second side 78 to terminal ends 102 and 104. There is a gap 109 located between fingers 92 and 94 and second side 78. Accordingly, because fingers 92 and 94 are only attached at base 90 and merely extend over second side 78, fingers 92 and 94 can be pushed together in a scissors-like manner with the most movement occurring at terminal ends 102 and 104.

Fingers 92 and 94 also have top sides 106 and 108, which have cavities 110 and 112 that located at approximately a mid-section 114 of fingers 92 and 94. Cavities 110 and 112 include latch surfaces 116 and 118, which are generally perpendicular to top sides 106 and 108 of fingers 92 and 94. Terminal ends 102 and 104 of fingers 92 and 94 have outer surfaces 120 and 122 and sloped surfaces 124 and 126.

Referring to FIGS. 1–11, plug 10 is assembled as follows. Second end 74 of mating portion 14 is received into opening 24 of housing 12. Main body 70 slides into opening 24 until plug stops 84 are received into slots 50. Plug stops 84 have a sloped surface 130 and a tab side 132. Plug stops 84 will slide into opening 24 along sloped surface and then hook into slot 50 at tab side 132. When plug stops 84 are received into slots 50, terminal ends 102 and 104 are received into cut out section 42. This is the unlatched position, as indicated in FIG. 1.

Plug stops 50 keep mating portion 14 movably secured to slidable housing 12. In other words, mating portion 14 can slide within slidable housing 12; however, plug stops 50 ensure that mating portion 14 does not come apart from slidable housing 12 when the user disengages modular plug 10 from the jack.

Figure 11:
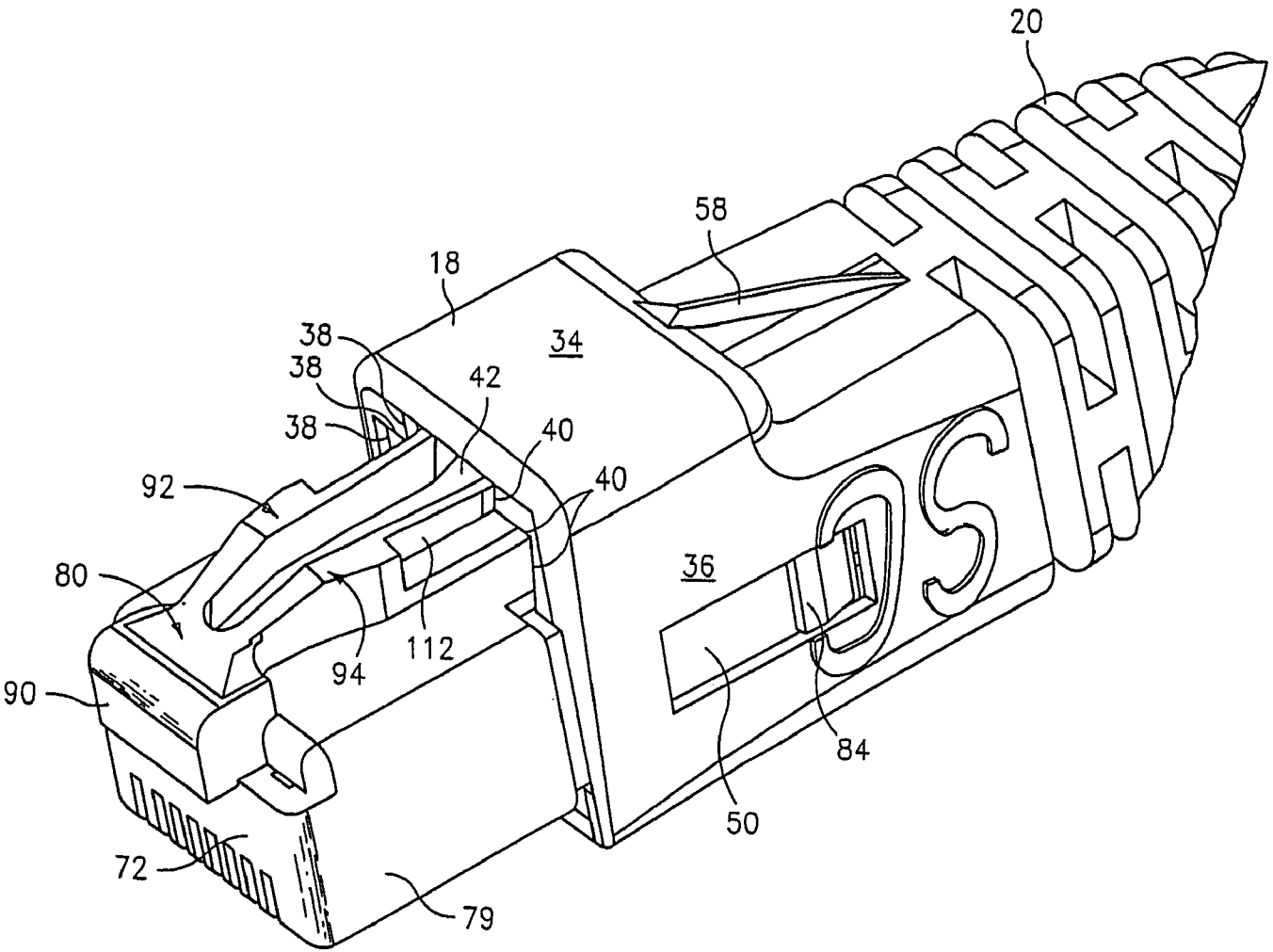
FIG. 11 is a front perspective view of the modular plug of FIG. 1 in a latched position.
Figure 12:
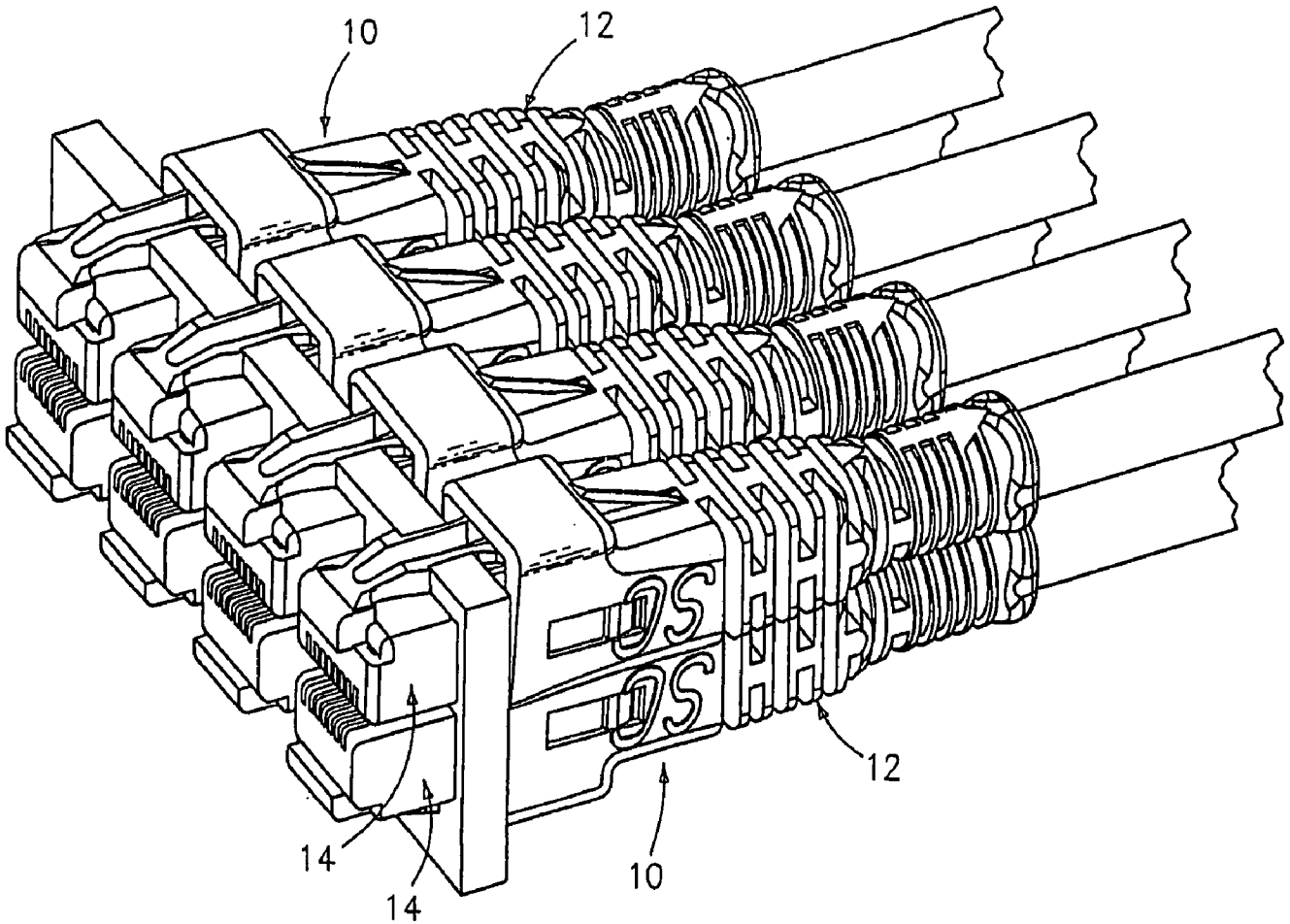
FIG. 12 is a front perspective view of a plurality of modular plugs connected to cables and to a patch panel.

As main body 70 continues to slide into opening 24 and into chamber 26, plug stops 84 slide along slots 50. In addition, fingers 92 and 94 slide along wedges 44 and 46. As sloped surfaces 124 and 126 engage with wedges 44 and 46, respectively, fingers 92 and 94 begin to move in an outward direction so that fingers 92 and 94 separate away from each other. Thus, the shape of wedges 44 and 46 and the shape of terminal ends 102 and 104 cause fingers 92 and 94 to move laterally in an outward direction towards first side 76 and third side 79, respectively. FIG. 11 indicates the latched position of plug in which housing 12 completely encloses indented portions 82 and fingers 92 and 94 are forced apart.

Figure 13:
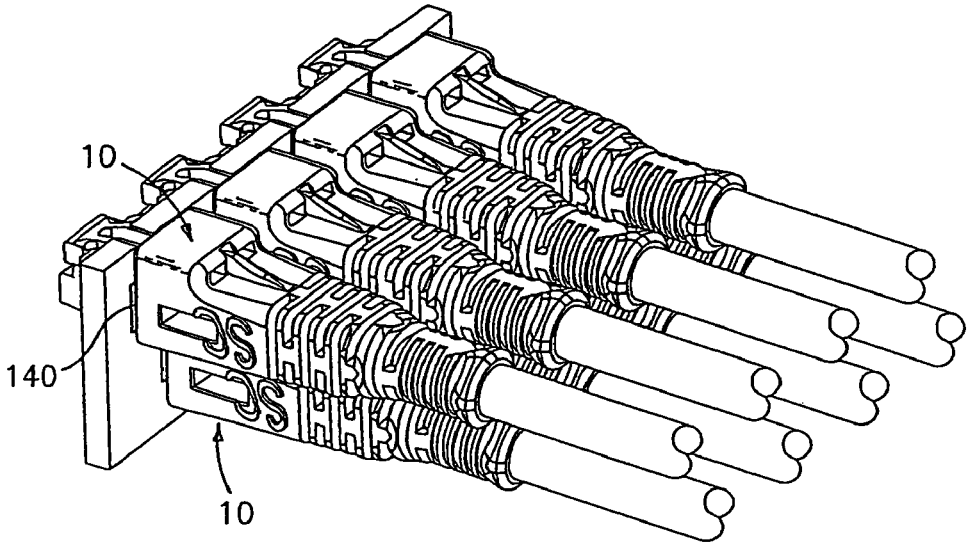
FIG. 13 is a back perspective views of a plurality of modular plugs connected to cables and to a patch panel.

Referring to FIGS. 1–13, plug 10 operates as follows. When plug 10 is in the unlatched position, as indicated in FIG. 1, the user grasps cable 30 at first end 16 of housing 12 and pushes mating portion 14 into a jack 140 (see FIG. 13). Jack 140 includes a RJ-45 jack. Once mating portion 14 has been inserted into jack 140, the user releases cable 30 and continues to grasp first end 16. The user pushes first end 16 towards jack 140. Housing 12 slides towards jack 140 so that plug stops 84 slide in slots 50 and fingers 92 and 94 slide into cut out section 42. As explained above, when fingers 92 and 94 slide into cut out section 42, wedges 44 and 46 engage sloped surfaces 124 and 126, which pushes fingers 92 and 94 in an outward lateral direction, as indicated in FIG. 11. This is the latched position. When this happens, latch surfaces 116 and 118 engage with the surfaces in jack 140 and lock plug 10 into jack 140. Thus, if the user releases housing 12 and grasps only cable 30 and pulls cable away from jack 140, plug 10 will not release from jack 140.

Plug 10 can be disengaged and released from jack 140 when the user grasps first end 16 and pulls in an outward direction, away from jack 140. When the user pulls on first end 16, terminal ends 102 and 104 slide along wedges 44 and 46, which pushes fingers 92 and 94 together. When fingers 92 and 94 are pushed together, latch surfaces 116 and 118 disengage from the surfaces of the jack 140, thereby releasing plug 10 from jack 140. This is the unlatched position.

Accordingly, when multiple cables are grouped together, an operator can grasp first end 16 of housing 12 and pull housing 12 so that it slides away from jack 140. When housing 12 is pulled away from jack 140, latch 80 disengages from jack 140 and releases mating portion 14 from jack 140.

Figure 14:
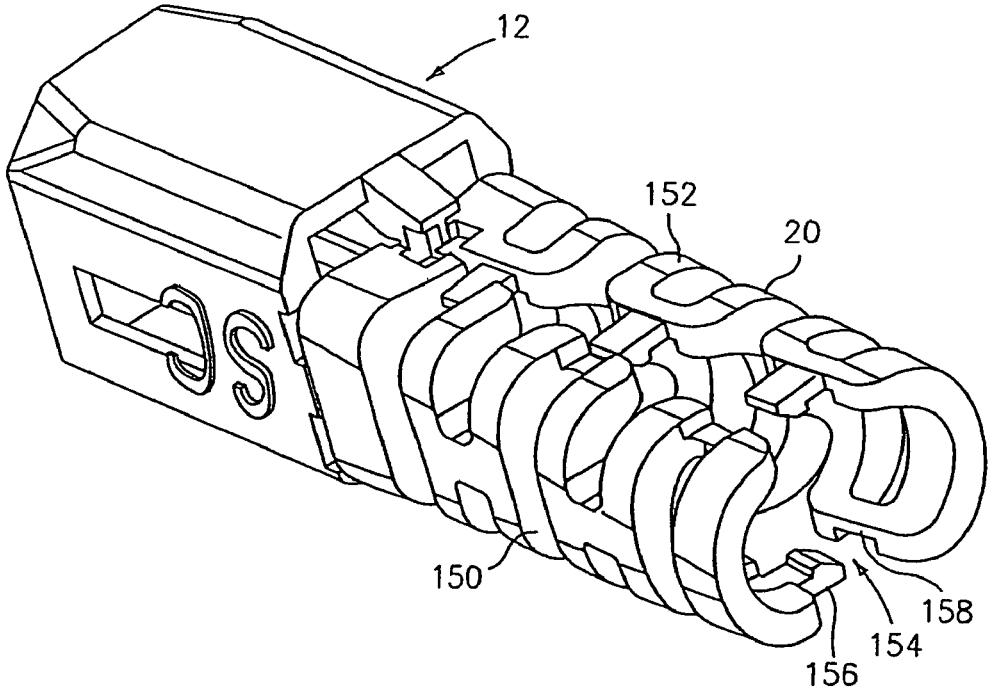
FIG. 14 is a back perspective view of an alternative embodiment of the slidable housing.
Figure 15:
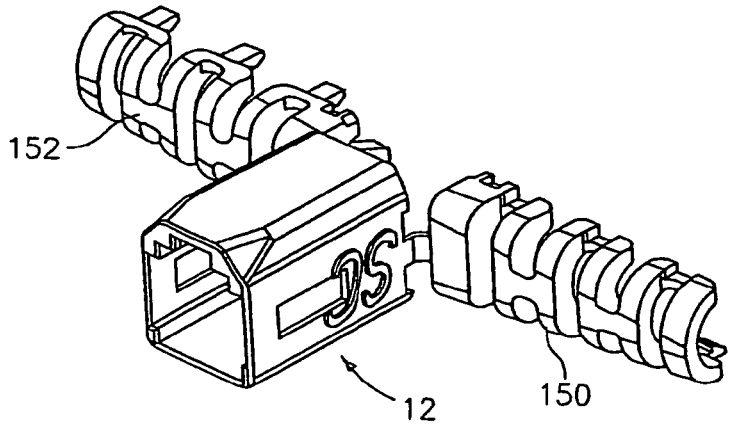
FIG. 15 is a front perspective view of the slidable housing of FIG. 14 in an open position.
Figure 16:
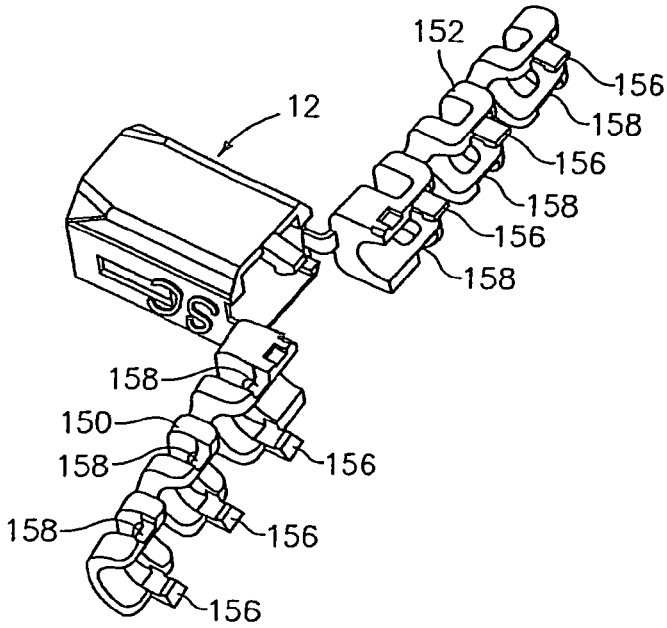
FIG. 16 is a back perspective view of the slidable housing of FIG. 14 in an open position.
Figure 17:
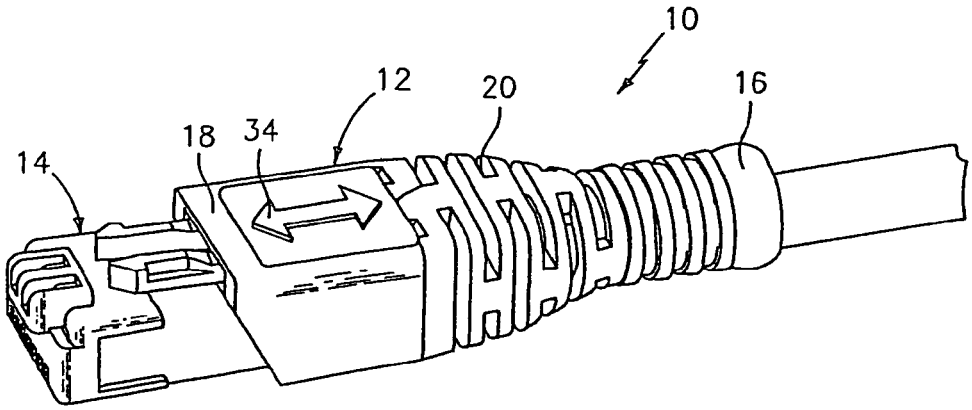
FIG. 17 is a side perspective view of an alternative embodiment of the modular plug.
Figure 18:
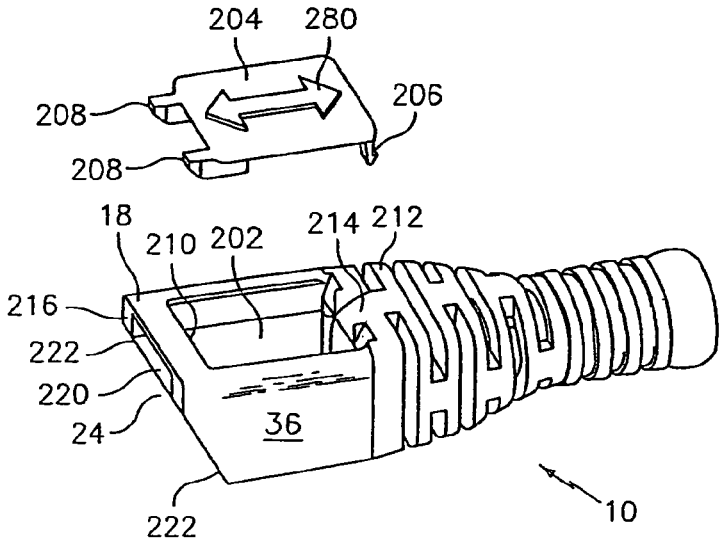
FIG. 18 is a side perspective view of the slidable housing of the modular plug of FIG. 17.
Figure 19:
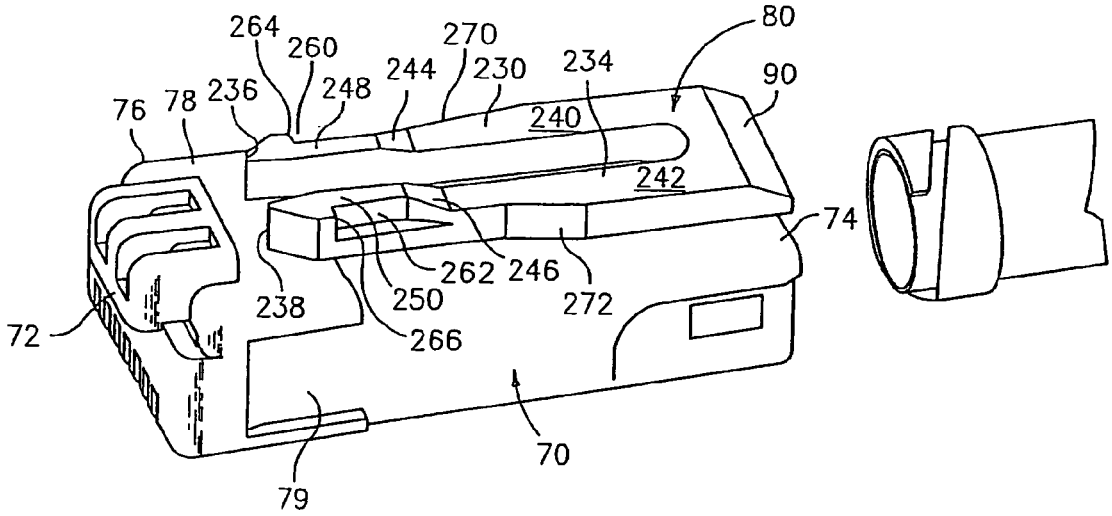
FIG. 19 is a side perspective view of the mating portion of the modular plug of FIG. 17.
Figure 20:
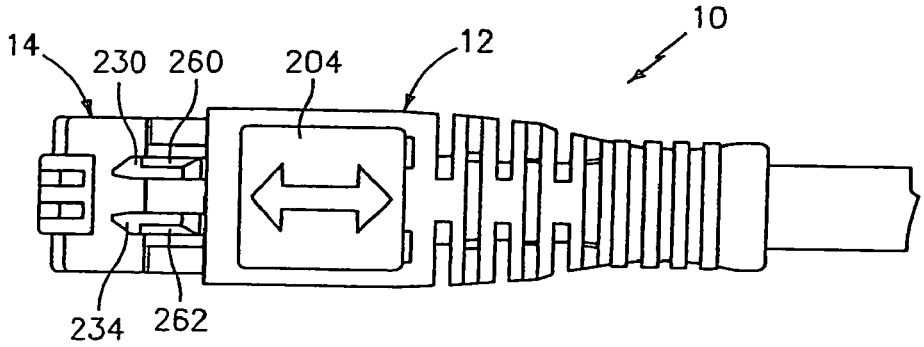
FIG. 20 is a top view of the modular plug of FIGS. 17–19.
Figure 21:
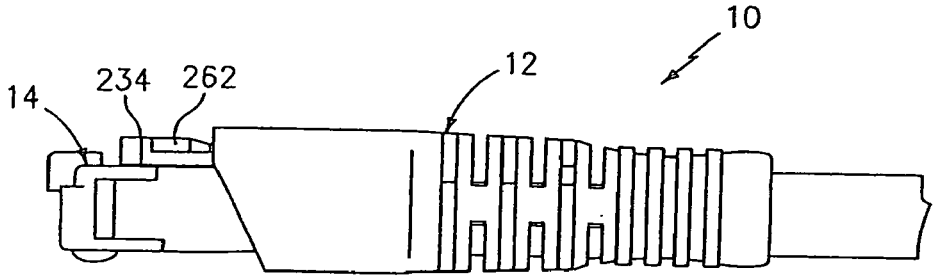
FIG. 21 is a side view of the modular plug of FIGS. 17–19.
Figure 22:
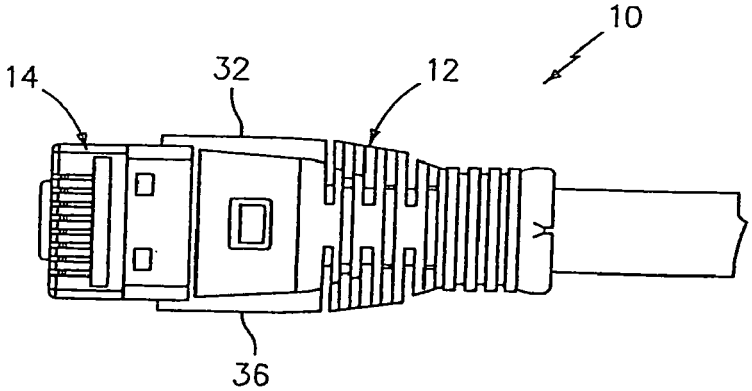
FIG. 22 is a bottom view of the modular plug of FIGS. 17–19.
Figure 23:
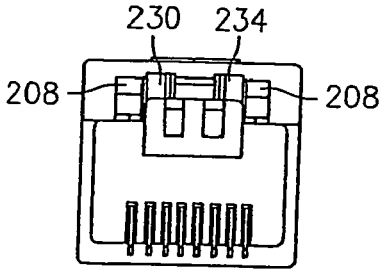
FIG. 23 is an end view of the modular plug of FIGS. 17–19.

Referring to FIGS. 14–16, an alternative embodiment of slidable housing 12 is illustrated. In this embodiment, first end 16 is removed and the user would grasp middle portion 20 to insert plug 10 (see FIG. 1) into jack 140 (see FIG. 13). In addition, middle portion 20 includes two sides 150 and 152 that swing away from each other. This type of housing allows for slidable housing 12 to clamp over cable 30 (see FIG. 1) in an easy manner. Sides 150 and 152 connected at a plurality of snap latches 154. Snap latches 154 include an extension 156 at sides 150 and 152 that hooks onto recess areas 158 at sides 150 and 152.

Referring to FIGS. 17–25, an alternative embodiment of modular plug 10 is illustrated. As with the first embodiment, plug 10 includes housing 12 and mating portion 14. Housing 12 includes first end 16, opposing second end 18, and middle portion 20. Second end 18 includes opening 24 and is sized to receive mating portion 14.

Housing 12 is similar to the first embodiment except for the differences set forth herein. As such, when describing this embodiment, all of the parts that remain the same have the same part numbers as with the first embodiment. Second end 18 has first side 32, second side 34, and third side 36. First side 32 is approximately parallel to third side 36, with second side 34 located approximately perpendicular to both first side 32 and third side 36. Second side 34 includes an opening 202 and a cover 204. Second end 18 also has an end face 216, which includes a rectangular slot 220. Cover 204 includes a gripper edge 206, two projections 208, and a stop 209 (shown in FIG. 24). Two projections 208 slide under a first edge 210 of opening 202 and gripper edge 206 hooks under a lip 212 of an opposing second edge 214 of opening 202. In addition, sides 32 and 36 do not have slots 50 as with the first embodiment, but rather have a sloped edge 222.

In addition, mating portion 14 is similar to the first embodiment except for the differences set forth herein. Mating portion 14 has main body 70 with first end 72 and opposing second end 74. Main body 70 also has first side 76, second side 78, and third side 79.

In this embodiment, latch 80 is connected to second end 74 at base 90. Latch 80 includes two fingers 230 and 232 that extend from base 90 over second side 78. Fingers 230 and 234 are generally parallel and extend away from base 90 over second side to terminal ends 236 and 238. While this embodiment depicts fingers 230 and 234 disposed in a generally parallel manner, fingers 230 and 234 are not required to be parallel in order for fingers 230 and 234 to function properly. In addition, because fingers 230 and 234 are only attached at base 90 and merely extend over second side 78, fingers 230 and 234 can be pushed together in a scissors-like manner with the most movement occurring at terminal ends 236 and 238.

Fingers 230 and 234 also have top sides 240 and 242, which have sloped surfaces 244 and 246 leading to top sides 248 and 250. As such, terminal ends 236 and 238 are thicker than fingers 230 and 234 at base 90. Top sides 248 and 250 have cavities 260 and 262 that located near terminal ends 236 and 238. Cavities 260 and 262 include latch surfaces 264 and 266, which are generally perpendicular to top sides 248 and 250. In addition, cavities 260 and 262 mirror each other on each finger 230 and 234.

Figure 24:
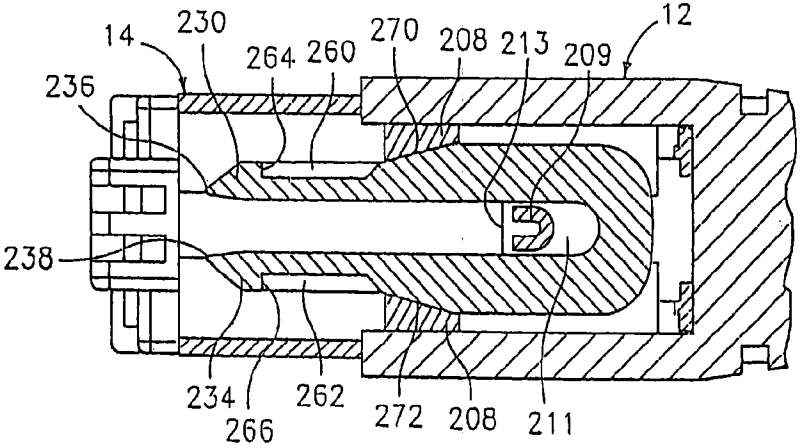
FIG. 24 is a top cross-sectional view of the modular plug of FIGS. 17–19 in a latched position.
Figure 25:
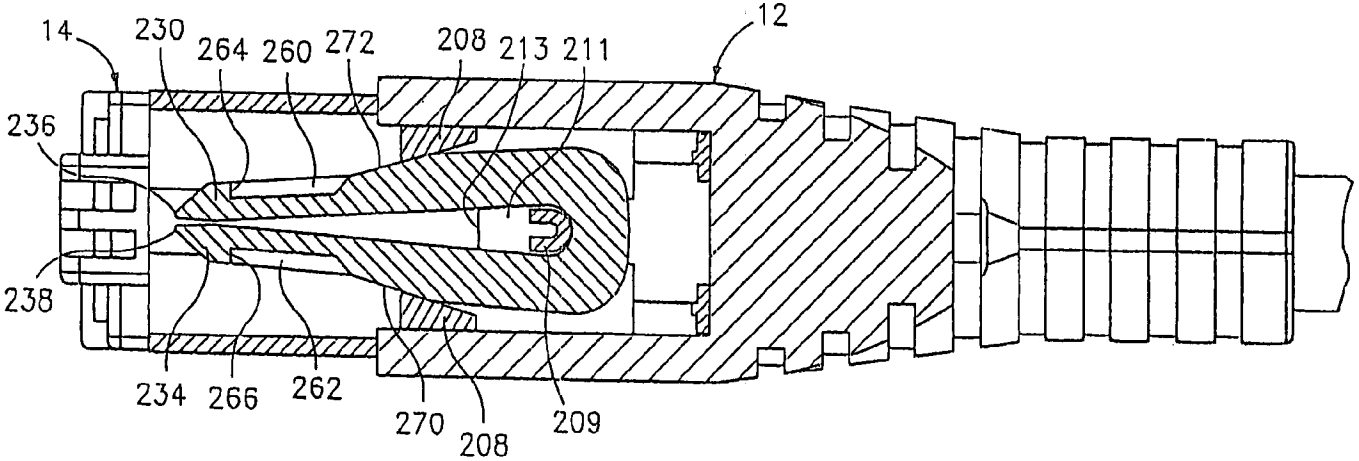
FIG. 25 is a top cross-sectional view of the modular plug of FIGS. 17–19 in an unlatched position.

Cover 204 includes stop 209, which is located between fingers 230 and 234 when cover 204 is attached to housing 12. Stop 209 extends into a cavity 211, which is formed by fingers 230 and 234, wall 213, and the back end of fingers 230 and 234. Cavity 211 is set into second side 78 of mating portion 14. Stop 209 can slide within cavity 211, as shown in FIGS. 24 and 25. Stop 209 has the same function as plug stops 84. Stop 209 keeps mating portion 14 movably secured to slidable housing 12. In other words, mating portion 14 can slide within slidable housing 12; however, stop 209 ensures that mating portion 14 does not come apart from slidable housing 12 when the user disengages modular plug 10 from the jack.

Fingers 230 and 234 also have cam surfaces 270 and 272, which are located at about a mid-point along the outer side of fingers 230 and 234.

Referring to FIGS. 17–25, plug 10 is assembled as follows. Cover 204 is removed from housing 12. Second end 74 of mating portion 14 is received into opening 24 of housing 12. Base 90 extends into slot 220. Mating portion 14 slides into housing until sloped surfaces 244 and 246 contact end face 216. Cover 204 is fitted into opening 202 by sliding projections 208 into opening 24 first and then gripper edge 206 is snapped under lip 212. Projections 208 rest along cam surfaces 270 and 272 as shown in FIG. 24. This is the latched position of modular plug 10.

Once cover 204 is in place, housing 12 can slide in the direction of arrow 280. When housing 12 slides towards second end 74, projections slide along cam surfaces 270 and 272 until projections 208 are at the edge of cam surfaces 270 and 272, as shown in FIG. 25. As projections 208 slide along cam surfaces 270 and 272, fingers 230 and 234 are pressed together. This is the unlatched position of modular plug 10.

Referring to FIGS. 13 and 17–25, plug 10 operates as follows. To mate the plug 10 with a jack, the plug may be placed in the unlatched position as shown in FIG. 25, inserted in the jack and then placed in the latched position shown in FIG. 24. Alternatively, when plug 10 is in the latched position, as indicated in FIG. 24, the user grasps first end 16 of housing 12 and pushes mating portion 14 into a jack 140 (see FIG. 13). Mating portion 14 slides into jack 140 until latch surfaces 264 and 266 engage with the surfaces in jack 140 and lock plug 10 into jack 140.

Plug 10 can be disengaged and released from jack 140 when the user grasps first end 16, and slides cover 204 away from the first end 72 of mating portion 14. As housing 12 slides toward second end 74, fingers 230 and 234 press together and release the jack surfaces from latch surfaces 264 and 266 so that mating portion 14 is no longer engaged with jack 140, thereby releasing plug 10 from jack 140. This is the unlatched position of the modular plug 10.

Figure 26:
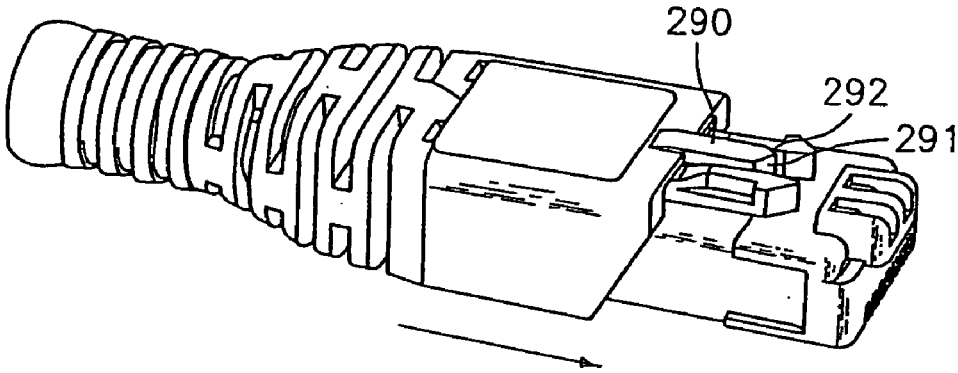
FIG. 26 is a top perspective view of the modular plug of FIG. 24 with an alternate slidable housing including a wedge.
Figure 27:
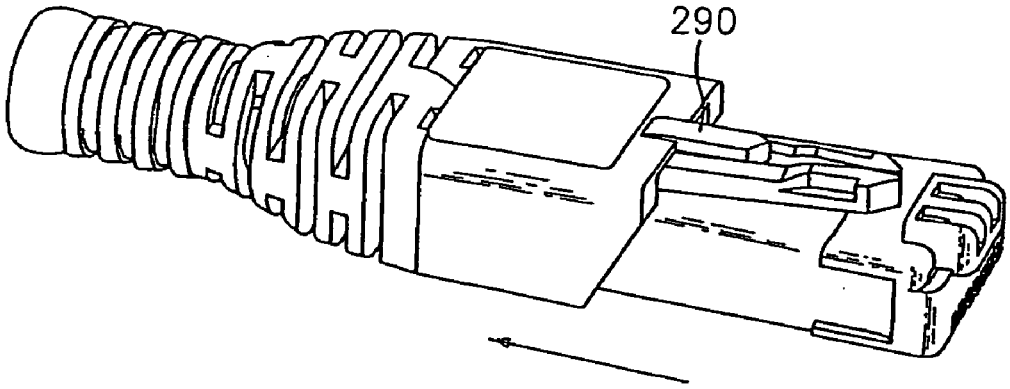
FIG. 27 is a top perspective view of the modular plug of FIG. 25 with an alternate slidable housing including a wedge.
Figure 28:
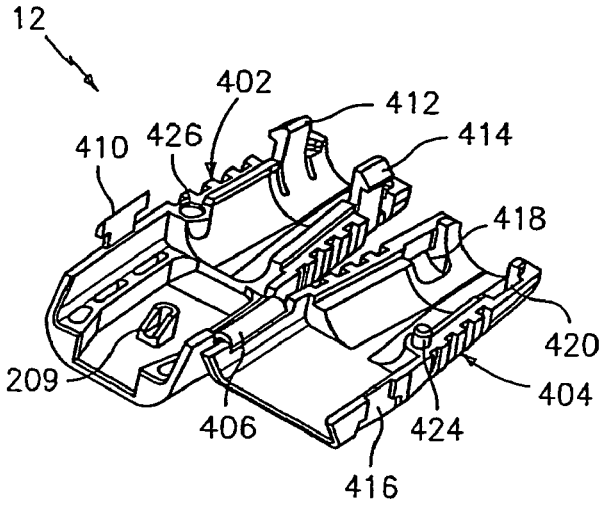
FIG. 28 is a front perspective view of an alternative embodiment of a slidable housing in an open position for the modular plug of FIGS. 17–19.
Figure 29:
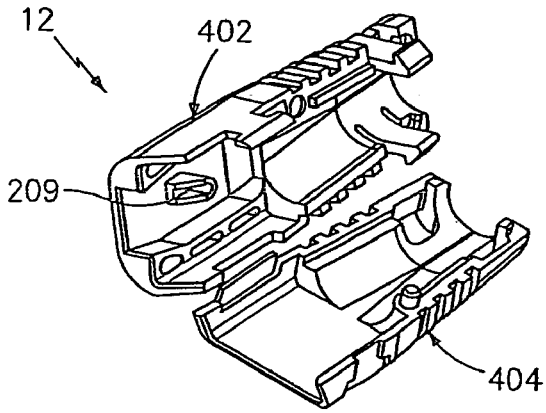
FIG. 29 is another front perspective view of the slidable housing of FIG. 28.
Figure 30:
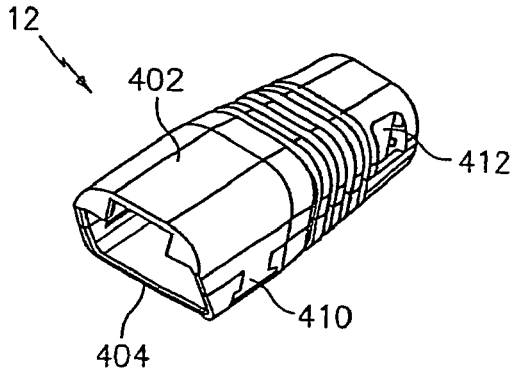
FIG. 30 is a front perspective view in the closed position of the slidable housing of FIG. 28.
Figure 31:
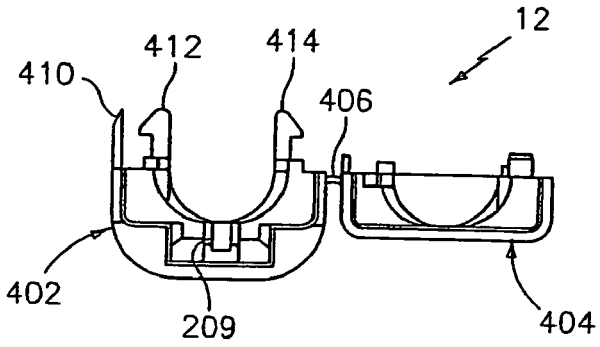
FIG. 31 is an end view of the slidable housing of FIGS. 28–30 in the open position.
Figure 32:
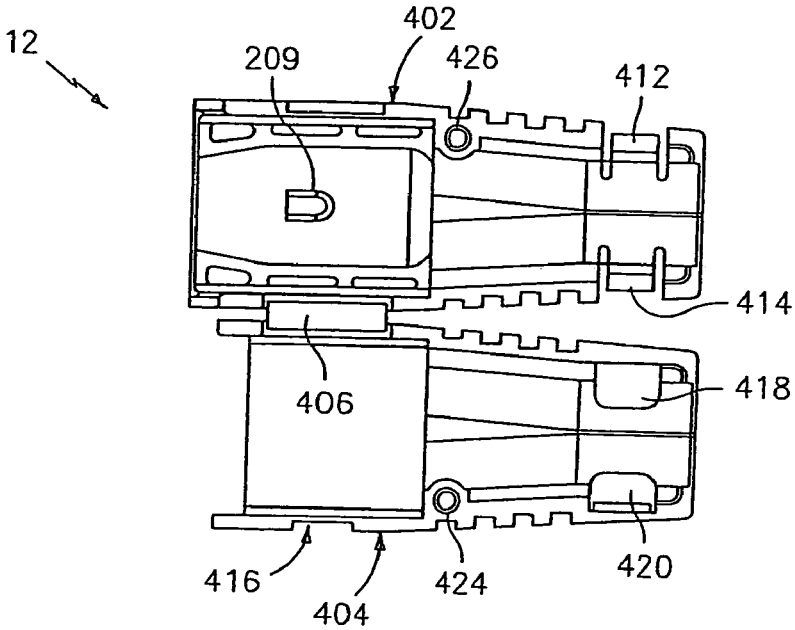
FIG. 32 is a top view of the slidable housing of FIGS. 28–30 in the open position.
Figure 33:
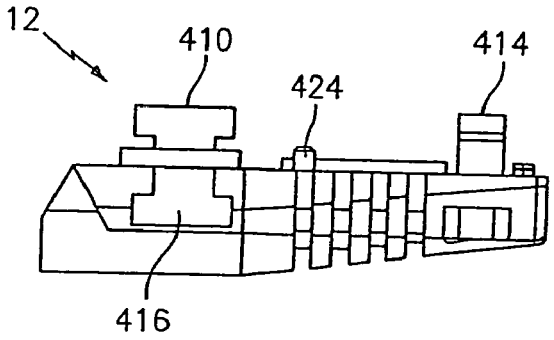
FIG. 33 is a side view of the slidable housing of FIGS. 28–30 in the open position.
Figure 34:
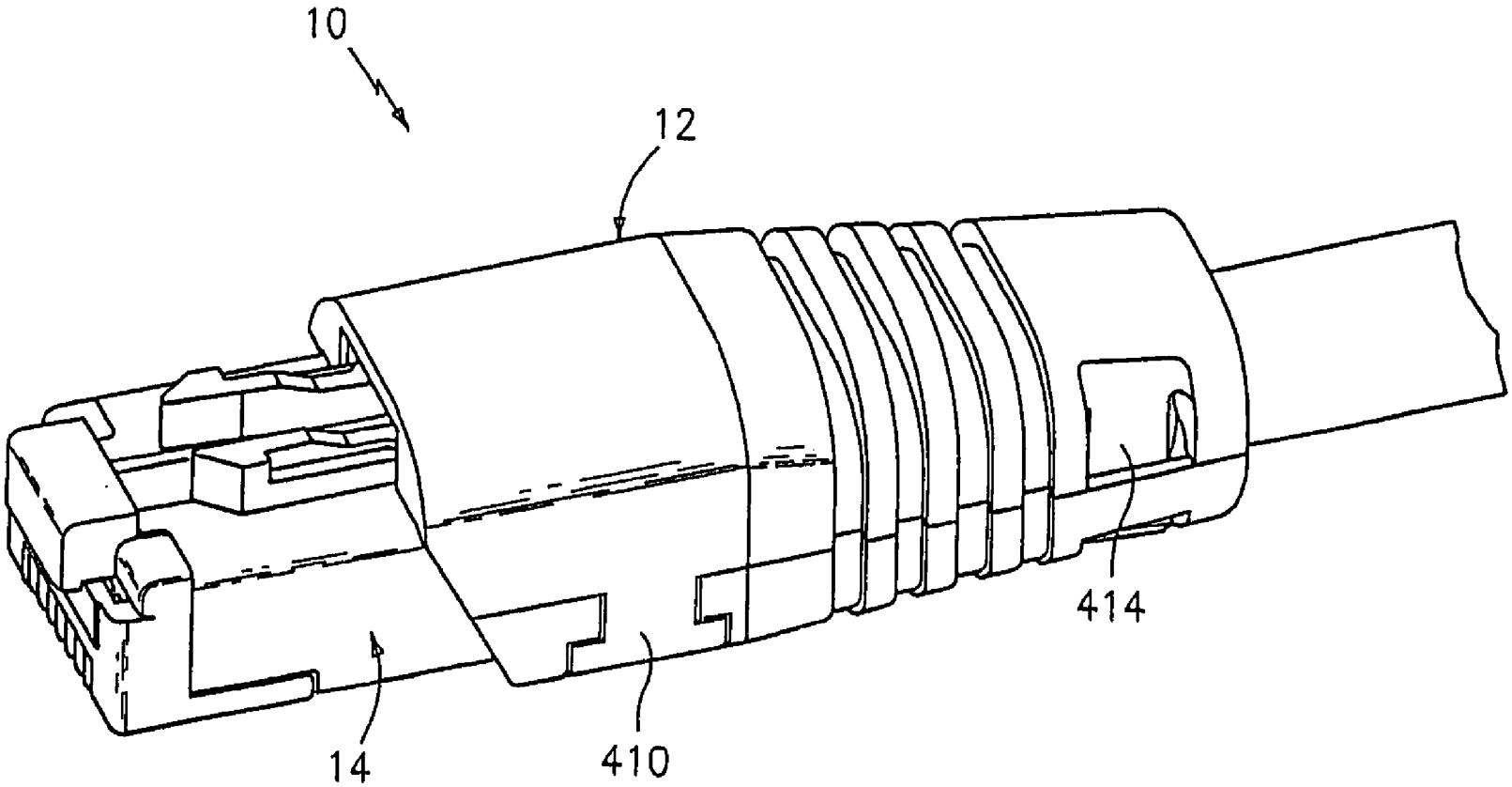
FIG. 34 is a perspective view of the modular plug with the slidable housing of FIGS. 28–30.
Figure 35:
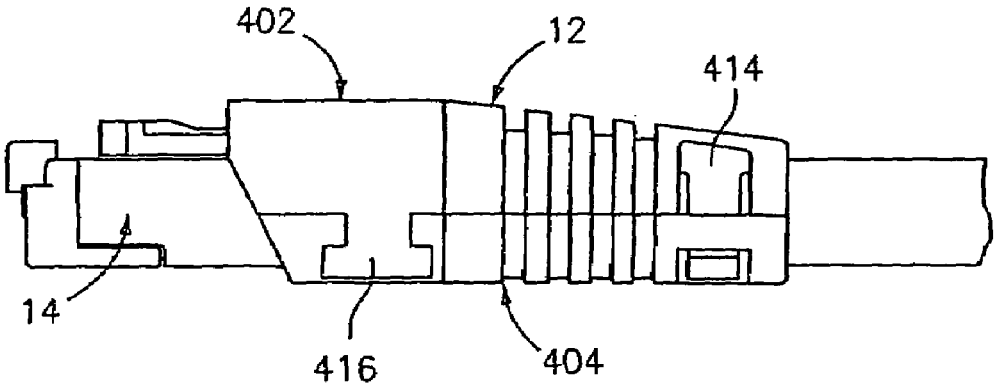
FIG. 35 is a side view of the modular plug with the slidable housing of FIGS. 28–30.
Figure 36:
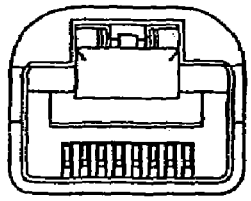
FIG. 36 is an end view of the modular plug with the slidable housing of FIGS. 28–30.
Figure 37:
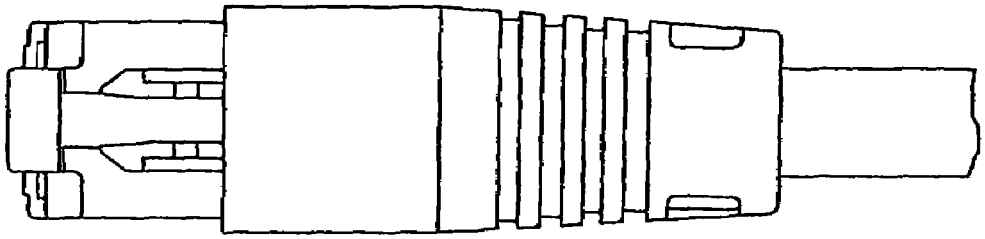
FIG. 37 is a top view of the modular plug with the slidable housing of FIGS. 28–30.

Referring to FIGS. 26–27, an alternative embodiment of slidable housing 12 is illustrated. The housing 12 in this embodiment is similar to the housing 12 displayed in FIGS. 17, 18 and 20 except that a wedge 290 is added to facilitate locking the fingers 230 and 234 in the latched position. In this embodiment, slidable housing 12 includes a wedge 290 which extends from the second end 18. The wedge 290 is disposed on the top surface of the endface 216 and protrudes in a direction substantially perpendicular to the endface 216. The wedge 290 includes sloped faces 291 and 292.

Referring to FIGS. 13 and 17–27, plug 10 operates as follows. To mate the plug 10 with a jack, the plug may be placed in the unlatched position as shown in FIG. 27, inserted in the jack 140 and then placed in the latched position shown in FIG. 26. Alternatively, when plug 10 is in the latched position, as indicated in FIG. 26, the user grasps first end 16 of housing 12 and pushes mating portion 14 into a jack 140 (see FIG. 13). Mating portion 14 slides into jack 140 until latch surfaces 264 and 266 engage with the surfaces in jack 140 and lock plug 10 into jack 140. When the user slides housing 12 toward first end 72 of mating portion 14, sloped faces 291 and 292 of wedge 290 are inserted between topsides 248 and 250. Thus, when plug 10 is in the latched position, as indicated in FIG. 26, the wedge 290 is positioned between the fingers 230 and 234 effectively locking them in the latched position.

Plug 10 can be disengaged and released from jack 140 when the user grasps first end 16, and slides housing 12 away from the first end 72 of mating portion 14. As housing 12 slides toward second end 74, the wedge 290 is withdrawn from its position between fingers 230 and 234, allowing fingers 230 and 234 to press together and release the jack surfaces from latch surfaces 264 and 266 so that mating portion 14 is no longer engaged with jack 140, thereby releasing plug 10 from jack 140. This is the unlatched position of the modular plug 10.

Referring to FIGS. 28–37, an alternative embodiment of slidable housing 12 is illustrated. In this embodiment, slidable housing 12 opens so that there is a top side 402 and a bottom side 404. In addition, there is no separate cover (see FIG. 18 with separate cover 204) and stop 209 extends from top side 402. Top side 402 may be connected to bottom side by a hinge 406. Top side 402 is secured to bottom side 404 by snap hooks 410, 412, and 414, all of which extend from top side 402, however, they could also extend from bottom side 404. Snap hooks are received into openings 416, 418, and 420, which are all sized to received the corresponding snap hooks and are disposed on bottom side 404. In addition, bottom side has a connector 424, which extends from bottom side 404 and is received into an opening 426, which is located on top side 402.

When assembling slidable housing 12 with mating portion 14, mating portion 14 is placed into bottom side 404 and top side 402 is closed over mating portion 14. Once top side 402 is secured to bottom side 404, mating portion cannot slide out of slideable housing 12 because stop 209 prevents mating portion 14 from sliding out of slideable housing 12. This embodiment of slideable housing 12 operates in the same manner as described above with respect to FIGS. 13 and 17–25.

Figure 38:
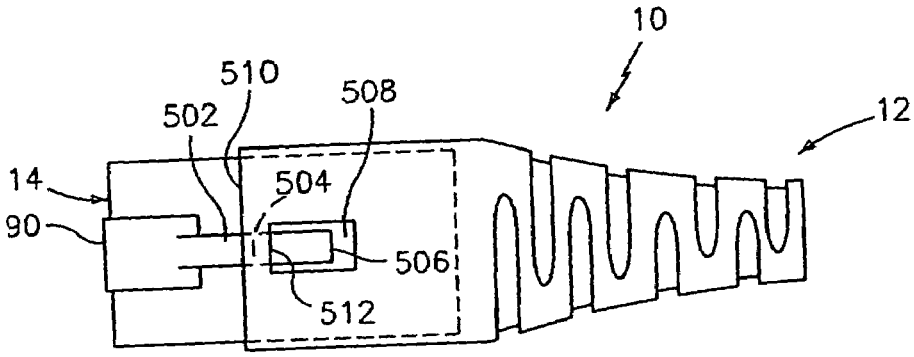
FIG. 38 is a top view of an alternative embodiment of the modular plug.
Figure 39:
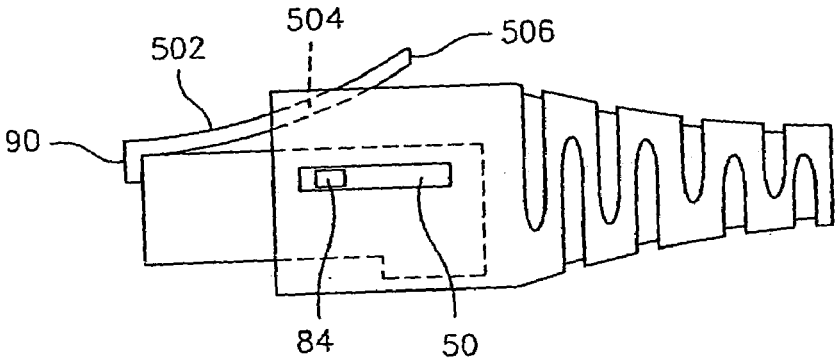
FIG. 39 is a side view of the modular plug of FIG. 38.
Figure 40:
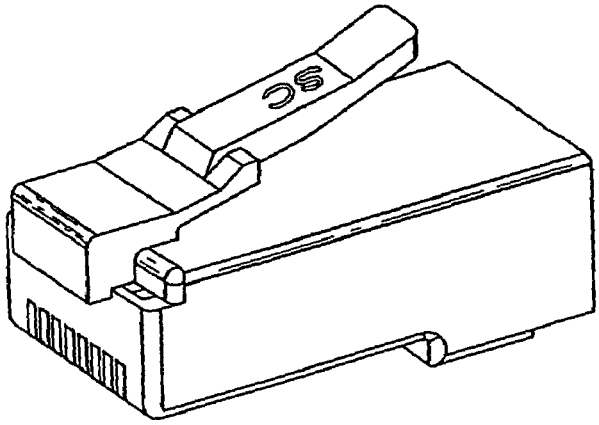
FIG. 40 (PRIOR ART)
FIG. 40 is a prior art latching system of a modular plug mating portion.

FIGS. 38 and 39 show an alternative embodiment of modular plug 10. In this embodiment, mating portion 14 has latch 502 extending from base 90. Latch 502 has a bend location 504 so that latch 502 bends away from second side 78 of mating portion. Latch 502 extends to an end 506. Slidable housing 12 has a window 508 that receives end 506 of latch 502.

Modular plug 10, which is shown in FIGS. 38–39, is assembled in the following manner. Mating portion 14 is received into chamber 26 of slidable housing 12 by sliding mating portion 14 into chamber 26. End 506 slides through window 508. Once end 506 is located in window 508, but before a front face 510 of slidable housing 12 reaches bend location 504 of latch 502, modular plug 10 is in the unlatched position. The modular plug 10 is now ready to be mated with a jack. Mating portion 14 is inserted into the jack and the user continues to slide slidable housing 12 continues to over mating portion 14 until front face 510 reaches bend location 504. This is the latched position. Once modular plug 10 is in the latched position, the user would then grasp slidable housing 12 and slide housing 12 in the opposite direction. As the user pulls the slidable housing 12 a cam surface 512 of window 508 pushes down on latch 502, which disengages mating portion 14 from the jack. In addition, slidable housing 12 includes slots 50, which engage plug stops 84.

The mating portion shown in the drawings is an RJ-45 plug having eight contacts, preferably used with cable having four twisted pairs of copper wire. One of the advantages of the axial latch actuator is that it can be mated with a standard outlet, which has not been modified. In other words, a face of the jack is flush with the opening of the jack so that the modular plug directly abuts the face of the jack. See FIG. 13. It is also understood that the mating portion may be altered to mate with non RJ-45 jacks and may be used with a variety of cable types such as coaxial cable, single fiber, duplex fiber, etc. Thus, embodiments of the invention are not limited to RJ-45, copper wire installations.

While the invention has been described with reference to exemplary embodiments, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiments disclosed for carrying out this invention.

The invention claimed is:

1. An axial latch actuator comprising:

a mating portion having a latch for engaging a jack, said latch having a latch surface; and a slidable housing that is configured to receive said mating portion, said mating portion slides within said slidable housing, said slidable housing is configured to slidably engage said latch surface so as to disengage said latch with said jack;

said latch further comprises a first finger and a second finger, said first finger having a first end and a second end, said first finger is connected to said mating portion at said first end and extends over a surface of said mating portion, said second finger being connected to said mating portion, said second finger extends over said surface of said mating portion.

2. The actuator of claim 1, wherein said slidable housing is disposed around said mating portion.

3. The actuator of claim 1, wherein said slidable housing includes a cover, said cover includes an extension that engages said latch at said latch surface.

4. The actuator of claim 1, wherein said slidable housing includes an extension that engages said latch at said latch surface.

5. The actuator of claim 1 wherein said first finger and said second finger are connected to each other.

6. The actuator of claim 5 wherein said first finger and said second finger are integrally connected to each other.

7. The actuator of claim 1, wherein said second end is configured so that it is free to moves in a lateral direction across said surface of said mating portion.

8. The actuator of claim 1, wherein when said mating portion is in said latched position, said first finger and second finger are forced apart.

9. The actuator of claim 1, wherein a mating end is sized to be received into an RJ-45 jack.

10. An axial latch actuator comprising:

a mating portion having a latch for engaging a jack; and a slidable housing that slides along said mating portion and engages said mating portion, wherein when said slidable housing slides in a first direction, said mating portion is in a latched position and when said slidable housing slides in a second direction, said mating portion is in an unlatched position, wherein said slidable housing includes a locking wedge; and said latch further comprises a first finger and a second finger, said first finger having a first end and a second end, said first finger is connected to said mating portion at said first end and extends over a surface of said mating portion, said second finger is connected to said mating portion, said second finger extends over said surface of said mating portion.

11. The actuator of claim 10, wherein said locking wedge is disposed between said fingers when said mating portion is in a latched position.

12. The actuator of claim 11, wherein said locking wedge prevents accidental unlatching of said mating portion.

13. The actuator of claim 10, wherein said locking wedge is disposed substantially apart from said upper surface of said fingers when said mating portion is in an unlatched position.

* * * * *